US009133528B2

(12) United States Patent
Frenzel et al.

(10) Patent No.: US 9,133,528 B2
(45) Date of Patent: Sep. 15, 2015

(54) RAW JUICE ALKALINIZATION

(75) Inventors: Stefan Frenzel, Weinheim (DE); Mohsen Ajdari Rad, Obrigheim (DE); Azar Shahidizenouz, Obrigheim (DE)

(73) Assignee: Suedzucker Aktiengesellschaft Mannheim/Ochsenfurt, Mannheim (DE)

( * ) Notice: Subject to any disclaimer, the term of this patent is extended or adjusted under 35 U.S.C. 154(b) by 1476 days.

(21) Appl. No.: 12/523,982

(22) PCT Filed: Jan. 22, 2008

(86) PCT No.: PCT/EP2008/000435

§ 371 (c)(1),
(2), (4) Date: Oct. 6, 2009

(87) PCT Pub. No.: WO2008/089946

PCT Pub. Date: Jul. 31, 2008

(65) Prior Publication Data

US 2010/0043783 A1 Feb. 25, 2010

(30) Foreign Application Priority Data

Jan. 24, 2007 (DE) ..... 10 2007 003 463

(51) Int. Cl.
*C13B 20/06* (2011.01)
*C13B 20/02* (2011.01)

(52) U.S. Cl.
CPC ..... *C13B 20/06* (2013.01); *C13B 20/02* (2013.01)

(58) Field of Classification Search
None
See application file for complete search history.

(56) References Cited

U.S. PATENT DOCUMENTS

| | | | | |
|---|---|---|---|---|
| 2,164,186 | A | 6/1939 | Brown et al. | |
| 2,697,049 | A | 12/1954 | Brieghel-Muller et al. | |
| 2,774,693 | A | 12/1956 | Brieghel-Mueller | |
| 2,824,028 | A * | 2/1958 | Zenzes | 127/50 |
| 3,734,773 | A * | 5/1973 | Haley | 127/48 |
| 3,834,941 | A | 9/1974 | Schoenrock et al. | |
| 4,795,494 | A * | 1/1989 | Toth et al. | 127/48 |
| 5,759,283 | A * | 6/1998 | Ekern et al. | 127/42 |
| 5,928,429 | A * | 7/1999 | Duncan et al. | 127/48 |
| 7,955,635 | B2 * | 6/2011 | Deneus et al. | 426/635 |
| 2001/0054420 | A1 * | 12/2001 | Reisig et al. | 127/55 |
| 2005/0175750 | A1 * | 8/2005 | Sanders | 426/481 |
| 2008/0017187 | A1 | 1/2008 | Deneus et al. | |
| 2009/0007902 | A1 | 1/2009 | Ajdari Rad et al. | |

FOREIGN PATENT DOCUMENTS

| | | | |
|---|---|---|---|
| DE | 103 50 672 | A1 | 6/2005 |
| DE | 10 2006 004103 | A1 | 8/2007 |

(Continued)

OTHER PUBLICATIONS

Dr. Dietrich Becker, Dormagen, "Brieghel-Mueller predefecation", Zucker, No. 17, pp. 383-385 (Sep. 1952) (and English translation of same).

(Continued)

*Primary Examiner* — Melvin C Mayes
*Assistant Examiner* — Sheng H Davis
(74) *Attorney, Agent, or Firm* — Dickstein Shapiro LLP

(57) ABSTRACT

The invention concerns an improved method for purification of raw sugar beet juice, which is obtained by extraction from sugar beets, and to devices for purification of raw sugar beet juice. The invention further concerns a method for producing sucrose syrup or sucrose from raw sugar beet raw.

17 Claims, 6 Drawing Sheets

(56) References Cited

FOREIGN PATENT DOCUMENTS

| | | | |
|---|---|---|---|
| GB | 329112 | * | 4/1929 |
| WO | WO-2005/042787 | | 5/2005 |

OTHER PUBLICATIONS

"Zur Frage der Vorscheidung (Concerning the question of predefecation)", Centralblatt fuer die Zuckerindustrie, No. 7, pp. 119-120 (1932) (and English translation of same).

English abstract of Mohsen Ajdari Rad, "Inline-Online Erfassung von Prozessablaeufeb bei der Extraktreinigung im Zuckerfabrikationsprozess Doctorarbeit", Technissen Universitat Berlin, XP008096546 (Berlin) (2002).

Van Der Poel et al., "Sugar Technology, Beet and Cane Sugar Manufacture", XP002496167, pp. 485, 488, 503-506 (1998).

Kraus et al., "Investigations of conditions for optimum colloid coagulation in preliming of beet juice", Zuckerind, vol. 122, No. 2, pp. 91-99 (1997).

"Portfolio of Foreign Purifying Technology of Beet Sugar Juice", Yang Changren, Light Industry Press, The First Edition on Aug. 1984, p. 9, 15-19, 108, 110-112, 159-162, 213-216, and 229.

"The Effect of Natural Alkalinity on Beet Sugar Production", Guo Jiqiang, Journal of Dalian Institute of Light Industry, vol. 12, No. 1, Apr. 1993, pp. 27-31.

English translation of Chinese Office Action issued for corresponding Chinese Application No. 200880002892.1, date of mailing Dec. 7, 2011.

* cited by examiner

RAW JUICE ALKALINIZATION

The invention concerns an improved method for purification of sugar beet raw juice, which is obtained from sugar beets by extraction, and devices for purification of sugar beet raw juice. This invention additionally concerns methods for producing sucrose syrup or sucrose from sugar beet raw juice.

PRIOR ART

Sugar (sucrose) is traditionally obtained from beets (sugar beets, Beta vulgaris) by first removing most of adhering dirt and leaf residues from the harvested beets. Then, the beets are washed and sliced with cutting machines into, as a rule, pencil-sized pieces [cossettes]. Sugar is obtained from the cossettes by extraction of the cossettes in hot extraction water at about 65° C. to 75° C. As a rule, a counterflow extraction is carried out in an extraction tower. The diffusion process is conventional. The subsequent filtration of the resulting raw beet juice and the pressability of the extracted cossettes is supported by acidification of the extraction water. The raw beet juice obtained in the extraction is then sent to a juice purification step, which is also called extract purification. Here, impurities contained in the raw juice, which are called nonsucrose substances [nonsugars] are removed. Usually, juice purification takes place as a lime-carbon dioxide extract purification; it contains the process steps of preliming and main liming. This is followed by a first and possibly a second or an additional carbonation, where precipitate formed in the carbonation is removed from the clarified raw juice by filtration.

The raw juice purified in the juice purification step, which is also called thin juice, contains about 12% to 18%, mostly about 15% to 17% sucrose. The purity of the raw juice is normally between 90% and 92%. It is then thickened by removing water to a thick juice with sucrose content of about 65% to 70%, and then thickened further in crystallizers to a viscous mass, the so-called thick juice, which contains about 85% sucrose. Finally, by filtering out the molasses, crystalline white sugar is obtained, which can then optionally be refined.

In the preliming and main liming, the nonsugars contained in the raw beet juice are not degraded enough that they can be removed by expedient separation methods. In known methods, the nonsugars are in part degraded to lower molecular compounds. These compounds can no longer be completely removed from the raw juice. Well-known problems include the disadvantageous development of color of the thin juice obtained from the juice purification that is connected with these compounds and the disadvantageously high calcium salt content of the thin juice. The presence of nonsugars degrades the production result, primarily thus the crystalline sucrose or the sucrose syrup obtained from the raw juice after thickening the thin juice and the subsequent crystallization and centrifuging.

The raw juice obtained from cossette extraction usually has a pH of about 5.8 to 6.2 and a temperature of about 20° C. to 30° C. After the extraction, the raw juice is optionally depulped and/or treated to remove sand and, as is known, heated to the known preliming temperature of about 55° C. to 75° C.

In the main preliming, the raw juice from the extraction is sent directly to the preliming vessel or reactor and alkalinized there, as a rule, in steps under mostly mild conditions by adding a calcium oxide solution, so called milk of lime. In doing so, we raise the pH of the raw juice in the preliming reactor in steps up to about pH 11.5. As is known, milk of lime is added up to a concentration of about 0.1 to 0.3 g calcium hydroxide per 100 mL raw juice [g CaO/100 mL]. This leads to neutralization of organic and inorganic acids present in the extract. Anionic compounds that form insoluble or sparingly soluble salts with the calcium, for example phosphate, oxalate, citrate, and sulfate, precipitate out to a very large degree. Moreover, proteins as well as colloidally dissolved nonsugars like pectin and protein substances coagulate. The precipitation of the nonsugars takes place within specific pH ranges, which are passed through in succession during the progressive alkalinization. Finally, there also takes place an agglomeration or compaction of the resulting precipitate, which then can be removed more easily.

In the main alkalinization conducted in the known way, the temperature is raised to about 85° C. The alkalinity of the raw juice is raised again by further addition of milk of lime, so that usually a concentration of about 1 g CaO/100 mL is reached. Thus, chemical decomposition of acid amides like glutamine takes place. These components, like the invert sugars formed by undesirable hydrolysis of sucrose, are mostly separated or degraded in an early phase of sucrose recovery. Otherwise a disadvantageous formation of acids and the development of color will take place in the subsequent juice thickening.

In the subsequent carbonation step lime not consumed in the main liming process is converted to calcium carbonate by introducing carbon dioxide as carbonation gas. Calcium carbonate is a strong adsorbent for soluble nonsugars. Calcium carbonate thus also serves as an adsorption and filtration aid. Carbon dioxide and unslaked lime for production of the milk of lime are as a rule obtained at the sugar plant in lime kilns, in which limestone is burned with coke. The calcium carbonate slurries that are concentrated via the filter in the first and preferably second and optionally additional carbonation steps (so called carbonation juice concentrates) are usually combined and pressed through membrane filter presses. This results in the so called carbonated lime. This carbonated lime is a storable product with a dry matter content as a rule of more than 70% and can, in some cases, be used as a fertilizer. Usually, a part of the carbonation juice concentrate is sent back to the preliming step.

A disadvantage of the traditional lime-carbon dioxide extract purification lies above all in the fact that the purification effect is still too low, since only a maximum of about 40% of all nonsugars can be removed from the raw beet juice.

Another disadvantage lies in the fact that invert sugar is formed by hydrolysis of the sucrose and reduces the quality of the resulting thin juice; above all, this has disadvantageous effects on the development of color in the thin juice (thin juice color). In addition, it is desirable that the calcium salt content caused by the fraction of nonsugars in the raw juice be as small as possible in the resulting thin juice.

In the known lime-carbon dioxide extract purification processes, the calcium carbonate that is formed acts as a filtration agent. If the milk of lime input is to be reduced, not only is the purification result degraded, but the filterability of the carbonation juice after carbonation also suffers. A criterion for evaluation of filterability is the filtration coefficient. The lower the value is, the better. Further, therefore, measures that reduce the filtration coefficients (FC value [$s/cm^2$]) of the limed raw juice (so called carbonation juices) during clarification in the first carbonation as much is possible are desirable in order to improve the efficiency of the filtration.

Statement of Task

This invention is based on the technical problem of making available an alternative and improved method for purification of sugar beet raw juice.

This invention solves the technical problem underlying it essentially by making available a method for purification of sugar beet raw juice that contains at least the following steps:

Step (a): Production of the raw juice by extraction of sugar beets;

Step (b): First (or so called early) alkalinization of the raw juice after extraction to a first alkalinity c;

Step (c): Heating the alkalinized raw juice to the preliming temperature T; and

Step (d): Preliming the alkalinized raw juice by a second alkalinization up to a second alkalinity for flocculation of the nonsugars.

The inventors found the following empirical relationship (Formula I) for the optimum first alkalinity:

$$c[pH]=a\cdot T[^\circ\text{ C.}]+b \quad (1)$$

In this case, an interval from 0.07 to 0.12 applies for a factor a and an interval of 2 to 4 applies to the summand b. Preferably, a is about 0.1. Preferably, b is about 3. Temperature T in this case is preferably 80° C. or lower.

The first alkalinity c in step (b) is always lower (lower pH value) than the second alkalinity (higher pH value) in step (d). It turned out that the pH (of about 5.8 to about 6.2) and the temperature (of about 20 up to about 30° C.) of the raw juice, as obtained immediately after traditional beet extraction and introduced directly into the preliming step in traditional extract purification processes, favors chemical, enzymic and microbiological decomposition reactions of the sucrose contained in it and other nonsugars. In addition, the prevailing acidic environment reduces the thermal stability of the raw juice, so that when raw juice is heated before or during the preliming step, additional nonsugars, primarily invert sugar, are formed.

It turned out that the formation of nonsugars in the raw juice before and during the preliming has a great effect on the quality of the thin, or the thick juice, primarily on its color and calcium salt content.

It further turned out that the microbiological activity in the raw juice as favored by the acid environment leads to the formation of slimy substances, which leads to the fouling of the raw juice heater (heat exchanger) and the filterability (FC value) of the carbonation juice, especially the first carbonation juice.

Surprisingly, the inventors found out that if the raw juice after extraction and before introduction into the preliming stage is alkalinized in a separate alkalinization step using one or more alkalis, for example, milk of lime, the main liming juice, sodium hydroxide and/or soda, the disadvantageous effects described above can be avoided. It turned out to be especially surprising that the advantageous effects are maximized if the pH value achieved in the raw juice alkalinization in accordance to the invention is selected independent on the subsequent preliming temperature. This means that the extent of the optimum first (or "early") alkalinization of the raw juice is dependent on the selected preliming temperature.

Accordingly, a preferred embodiment of the method in accordance with the invention calls for a first alkalinity c to be selected in dependence on the preliming temperature T in step (d) [during] the alkalinization of the raw juice in step (b). Expediently, c takes on values of about 7 up to about 11. Preferably, c has a pH of 9 or less.

Preferably, the preliming temperature T in steps (c) and/or (d) is 80° C. or lower or 75° C. or lower and, preferably is from 50° C. to 75° C.

Preferably, the first alkalinization in step (b) in accordance with the invention takes place immediately after the extraction, preferably immediately after the mash. Preferably, in step (b), the first alkalinization takes place by the addition of the main liming juice that was preferably returned from the extract purification process, and/or by the addition of milk of lime and/or by the addition of sodium hydroxide and/or soda and/or mixtures thereof.

Preferably in step (d), the following (traditional), second alkalinization takes place in the form of preliming by the addition of milk of lime up to a total concentration of 0.1 to 0.3 g CaO/100 mL. In a preferred variation, in step (d), the second alkalinization takes place progressively up to an alkalinity of pH 11 or higher. In a preferred variation in step (d), the second alkalinization takes place progressively up to achievement of the optimum flocculation point, at which the nonsugars coagulate and/or precipitate.

In particular, it is provided that the first alkalinization of the sugar beet raw juice and also the second alkalinization takes place during the preliming, preferably in counterflow by means of returned, already alkalinized raw juice, for example, carbonation juice concentrate from the carbonation steps and/or the raw juice limed in the main liming step ["main-limed" juice].

In connection with this invention, the terms "beet raw juice" or "raw juice" is understood to mean the juice that is preferably extracted from sugar beet cossettes by counterflow extraction. This sugar-rich raw juice contains, in addition to sugar, still other organic and inorganic components of the beet, which are called nonsugar substances or nonsugars. "Nonsugars" are understood to mean primarily high-molecular substances like proteins, polysaccharides, and cell wall components, and also low-molecular compounds like inorganic or organic acids, amino acids, and mineral salts. The cell wall components are in particular pectins, lignin, cellulose, and hemicellulose. Like the proteins, which include nucleoproteins in addition to proteins, are in the form of hydrophilic macromolecules in colloidally dispersed form. The organic acids are, for example, lactate, citrate, and oxalate. The inorganic acids/salts are in particular sulfates and phosphates.

"Milk of lime" is understood to mean calcium hydroxide that is formed in the strongly exothermic reaction of slaked lime (calcium oxide) with water and is used as a liming agent in the preliming and main liming. The addition of milk of lime to the raw juice in the preliming causes the precipitation or coagulation of nonsugars in the form of a coagulate. The addition of milk of lime to the preliming of the raw juice preferably takes place in accordance with the invention as a progressive preliming. The progressive preliming takes place by a gradual increase of the alkalinity or the pH value of the raw juice, preferably by slow feed of the milk of lime and liming agent or by small separated additions of individual portions of milk of lime, so that in particular the pH optimum is passed through slowly. Progressive alkalinization is preferably carried out in counterflow, where the returned juice with higher alkalinity is mixed as rapidly as possible with a juice having lower alkalinity so that different alkalinity gradients are not able to form in the mixing zone. While using appropriate transport systems in the preliming apparatus, care is taken within the system that the necessary amount of return is supplied at a highly constant rate toward the main direction of flow.

Preferably immediately, thereafter, in step (e), at least one main liming step is preferably added, in which the prelimed juice is subjected to main liming. This is preferably characterized by the fact that the resulting preliming juice is additionally alkalinized. For this, additional milk of lime is introduced, so that a concentration of preferably 1.0 g CaO/100 mL is achieved. Preferably, the main liming is carried out in two steps.

Surprisingly, the inventors found that the efficiency of the separation and decomposition of nonsugars during the main liming step can be improved by a first cold primary liming and a connected second hot primary liming. The input of milk of lime in the main liming can also be reduced through this. In this case, in the first step, (e1), a first main liming takes place and in a step (e2), preferably immediately thereafter, a second main liming takes place.

In step (e1), preferably additional milk of lime is added to the preliming juice until a concentration of 0.8 to 1.2 g CaO/100 mL, preferably 1.0 g CaO/100 mL is reached. In this way, a main-limed raw juice is obtained. Preferably, the first main liming is carried out as a "cold main liming" at a low temperature, i.e., at a temperature of 75° C. or lower, preferably 70° C., preferably 65° C. or lower, especially preferably in a temperature range of 35° C. to 65° C.

In the preferably additional step (e2), the second main liming of the main-limed raw juice takes place where optionally additional milk of lime is added up to a concentration of preferably 1.0 CaO/100 mL. Preferably, the second main liming is carried out as a "hot main liming" at a high temperature, i.e., at a temperature of more than 75° C., preferably 80° C. or higher, preferably 85° C. or higher, especially preferably in a temperature range of 85° C. to 95° C. Preferably, the elevated temperature in the second main liming is achieved by connecting a heat exchanger or an instantaneous heater, through which the main liming juice flows.

All in all, through the more efficient extract purification, a clarified raw juice can be obtained with higher quality and optionally, a post-liming of the raw juice after the first carbonation step can be omitted. The method in accordance to the invention is advantageously also suitable for processing beet material of lower quality, especially age-damaged beets. This means above all that the campaign time, i.e., the time in which the harvested and intermediately stored beets are processed in sugar plant, can be extended.

In the known extract purification processes, the reduction of lime consumption is limited, among other things, by the deterioration of filterability. Surprisingly, it turns out that this limitation can be overcome by the method in accordance with the invention.

Preferably, after the main liming, preferably a first main liming, and before the clarification of the limed raw juice, at least one flocculation agent is added to the sludge to improve the settling of the nonsugars fraction. Preferably, the flocculation agent is added up to a concentration of 1-8 ppm. Preferably, the flocculation agent is chosen from polyanionic macromolecules, preferably acrylamide and copolymers of acrylamide and sodium acrylate. Preferably, the flocculation agent has an average molecular weight of an average of about $5\times10^6$ to $22\times10^6$ g/mol.

Preferably, the separated nonsugars or the nonsugars-containing fraction is concentrated as the so called thin sludge. In doing so, in at least one additional step, a sucrose-contained fraction is separated therefrom in one or more separation devices, through which the nonsugars fraction becomes further concentrated. Preferably, a centrifuge is used as separation device. The centrifuge is preferably chosen from disk centrifuges or disk separators and decanter centrifuges. The separation devices are, as desired, connected immediately in series; however, it is also foreseen that the sludge outlet of a first separation device is connected to the inlet of a second additional separation device via a mixing vessel or a similar device. Preferably, the sucrose-containing clear juices or sweet juices separated from the second and additional separation devices are returned to the extract purification process in accordance with the invention.

In a preferred embodiment, the limed raw juice is sent to carbonation after the main liming. Preferably, for this, in a step that preferably immediately follows, at least one carbonation is carried out by introducing carbon dioxide into the main liming juice. Filtration of the resulting sludge takes place at the end of the carbonation. A clear sucrose syrup is obtained. The carbonation essentially takes place in a substantially known way. Especially preferably, the carbonation is designed as a two- or multistep carbonation. Preferably, a first carbonation and a first filtration take place in a step and, preferably immediately thereafter a second carbonation and second filtration takes place. At the end of the second carbonation, a third and further carbonations and filtrations can follow, in each case according to the field of application and advisability.

Another object of the invention is a method for producing sucrose syrup from beet raw juice. This method comprises, in accordance with the invention, in the first step, the making available of the sugar beet raw juice, as is preferably obtained from counterflow extraction of sugar beet cossettes. Accordingly, the extract purification method in accordance with the invention is carried out with at least the steps (a) through (d), preferably (a) through (e), as described above. Then, in an additional step, a clarified sucrose syrup that is free of nonsugars is obtained. It can optionally be crystallized in an additional step in a substantially known way, so that crystalline sucrose is obtained.

Finally, another object of the invention is a device for conducting the extra purification process in accordance with the invention. It has at least the following elements: A first alkalinization device (10), a preliming device (30), and connected between them, a first heat exchanger (20) (see FIGS. 1 and 2).

In the first alkalinization device (10) serves for alkalinization of the raw juice and has at least one inlet (11) for the raw juice, at least one metering device (13) for dispensing alkalis and at least one outlet (12) for the alkalinized raw juice. Preferably, the first alkalinization device (10) is made as a static mixer. In a preferred variation, the inlet (11) of the first alkalinization device (10) is in direct fluid connection with a mash vessel of the extraction step for the extraction of sugar beets.

The preliming device (30) serves for preliming the alkalized raw juice and has at least one inlet (31) for the alkalized raw juice, at least one metering device (33) for dispensing milk of lime, and at least one outlet (32) for the prelimed raw juice.

The first heat exchanger (20) serves to heat the raw juice alkalinized in the first alkalinizer (10) and has at least one inlet (21) for the alkalized raw juice and at least one outlet (22) for the heated limed raw juice; the inlet (21) is in fluid connection with the outlet (12) of the first alkalinizer (10), and the outlet (22) is in fluid connection with the inlet (31) of the prelimer (30).

In a preferred embodiment, the device in accordance with the invention has at least the following additional elements: a first main limer (40); a second main limer (60) and a second heat exchanger connected between them (50).

The first main limer (40) serves to conduct the first main liming, in particular the cold main liming, of the limed raw juice and has at least one inlet (41) for the raw juice, at least one metering device (43) for dispensing the milk of lime, and at least one outlet (42) for the main-limed raw juice.

The second main limer (60) serves to conduct the second main liming, in particular the hot main liming of the main-limed raw juice and has at least one inlet (61) for the raw juice, optionally at least one metering device (63) for dispensing of milk of lime, and at least one outlet (62) for the main-limed raw juice.

The second heat exchanger (50) serves to heat the raw juice that is main-limed in the first main limer (40) and has at least one inlet (51) for the main-limed raw juice and at least one outlet (52) for the heated main-limed raw juice; the inlet (51) is in fluid connection with the outlet (42) of the first main limer (40) and the outlet (52) is in fluid connection with the inlet (61) of the second main limer (60).

EMBODIMENT EXAMPLE

The invention is explained in more detail via the following example and the figures whereby these are understood to be non-limiting.

FIG. 1 shows a schematic drawing of a preferred device in accordance with the invention. The device has a first alkalinizer (10), a prelimer (30), and a first heat exchanger (20) connected between them; the first alkalinizer (10) has an inlet (11) for the raw juice, a metering device (13), and an outlet (12) for the alkalized raw juice; the prelimer (30) has a first inlet (31) for the alkalized raw juice, a metering device (33), and an outlet (32) for the prelimed raw juice; the (first) heat exchanger (20) has an inlet (21) for the alkalized raw juice and at least one outlet (22) for the heated limed raw juice; the inlet (21) is in fluid connection with the outlet (12) of the first alkalinizer (10) and the outlet (22) is in fluid connection with the inlet (31) of the prelimer (30).

FIG. 2 shows another preferred arrangement of the device in accordance with the invention. The device has a first alkalinizer (10), a prelimer (30), and a first heat exchanger (20) connected between them as well as a first new main limer (40); a second main limer (60), and a second heat exchanger (50) connected inbetween; the first alkalinizer (10) has an inlet (11), a metering device (13), and an outlet (12); the prelimer (30) has an inlet (31), a metering device (32) and an outlet (32); the (first) heat exchanger (20) has an inlet (21) and an outlet (22), the inlet (21) is in fluid connection with the outlet (12) of the first alkalinizer (10) and the outlet (22) is in fluid connection with the inlet (31) of the prelimer (30); the first main limer (40) has an inlet (41) for the raw juice, a metering device (43), and an outlet (42) for the main-limed raw juice; the second main limer (60) has an inlet (61) for the raw juice and an outlet (62) for the main-limed raw juice; the second heat exchanger (50) has an inlet (51) for the main-limed raw juice and an outlet (52) for the heated main-limed raw juice; the inlet (51) is in fluid connection with the outlet (42) of the first main limer (40) and the outlet (52) is in fluid connection with the inlet (61) of the second main limer (60).

EXAMPLE

Figure 1:
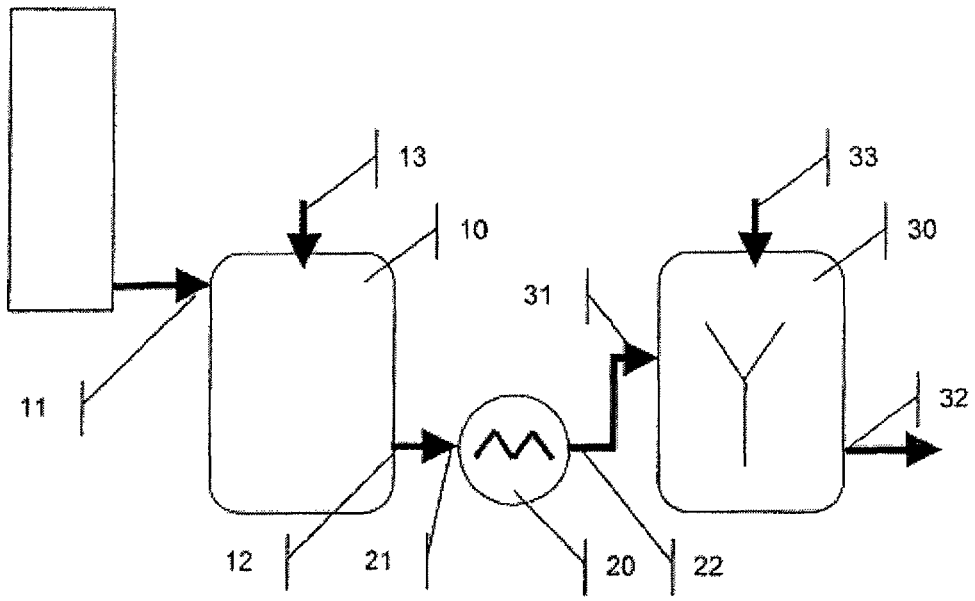
Figure 2:
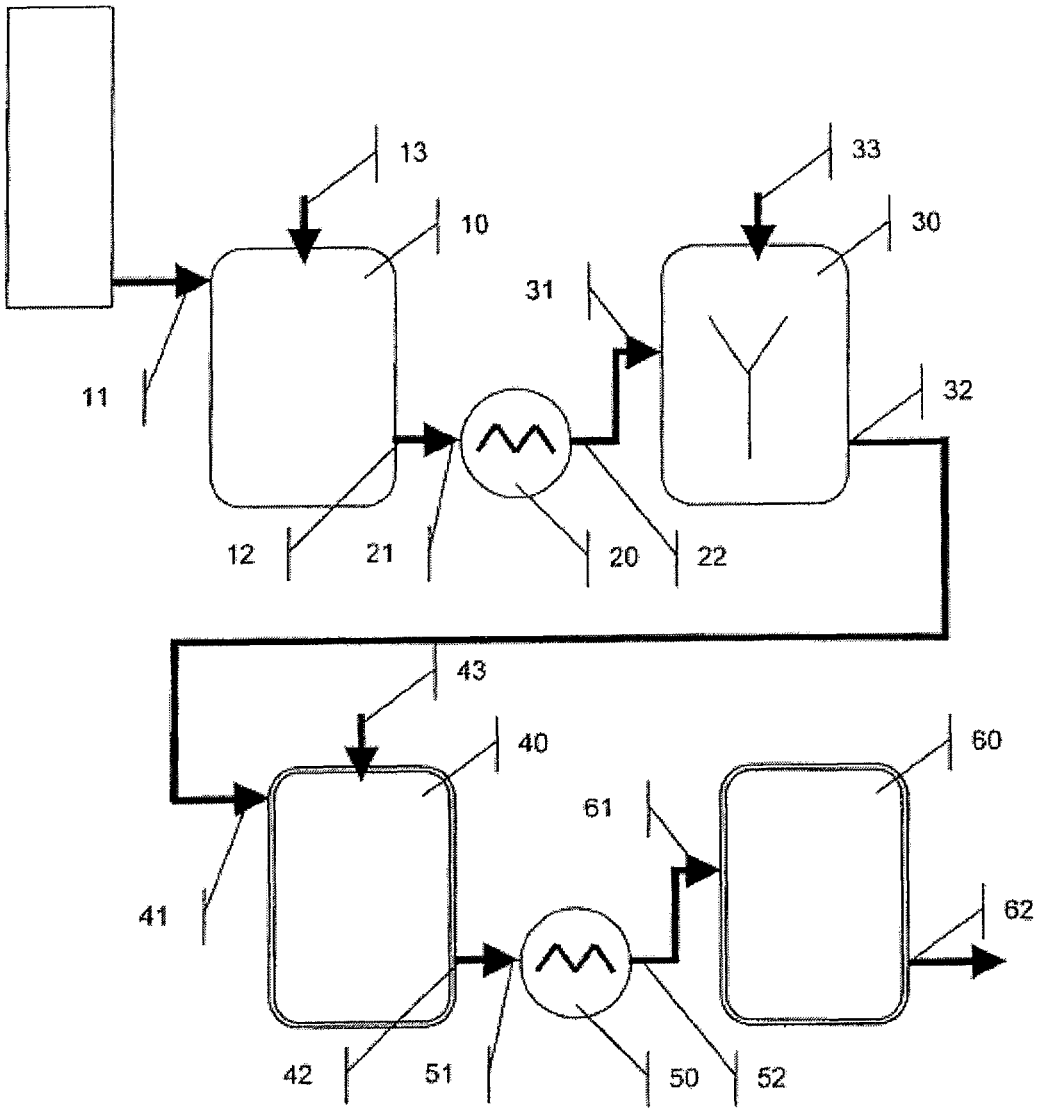

Raw Juice Purification with Early First Raw Juice Alkalinization

1. Extraction of Sugar Beet

Sugar beets, which were freshly harvested or stored for some time are washed and then chopped in a cutting machine with a cutting tool. The chopped beet cossettes are sent via a mash vessel to a counterflow extraction unit and extracted in it. The temperature in the extraction is about 75° C. A tower extractor is used as an extractor, in which the cossettes are extracted in counterflow with heated fresh water. The so-called beet raw juice is obtained as extract.

2. Purification of the Beet Raw Juice 2.1 Raw Juice Alkalinization

The technical grade raw juice is alkalinized in a first step in a separate alkalinization vessel by adding milk of lime to a pH of 6.0 to 11.0, the so-called "raw juice prealkalinization." The alkalinization vessel is a heated vessel with agitator, CO2 inlet pipe, and pH electrode. In the raw juice prealkalinization, the raw juice is heated to the necessary preliming temperature of about 55° C. to 85° C.

Preliming

The addition of milk of lime to the raw juice up to the pH value of the optimum flocculation point (pH 11.40) took place progressively (stepwise; in this specific case seven steps were used). The addition takes place over 20 minutes on monitoring the pH at specific time intervals. Then, a five-minute pH pause was conducted.

In the preliming, flocculation of nonsugars takes place by coagulation of the nonsugars with each other and by precipitation by the added milk of lime.

Main Liming

After completion of preliming, the prelimed raw juice is subjected to a first cold main liming in a connected additional alkalinization vessel. Through this, the alkalinity is increased to 1.0 g CaO/100 mL by further addition of milk of lime. The temperature in the hot main liming is about 85° C.; it is maintained for about 20 min.

First Carbonation

The first carbonation takes place at 8° C. with the feed of carbon dioxide. During the feed of carbon dioxide, the pH is observed as described above. The carbonation takes place within 15 min up to a pH value of 11.20.

Second Carbonation

The carbonation juice 1 obtained from the first carbonation is filtered with a filter bottle via a Buchner funnel. A Schleicher & Schuell 589/1 round black ribbon filter, ash-free (12 μm) is used as filter material. The filtrate of the first carbonation is sent back to the cleaned reactor and again heated to about 88° C. This is followed by another addition of carbon dioxide up until the pH of the juice has been adjusted to be 9.25 (within 10 min). Then, the dispensing stops. After a post-reaction time of 10 min, the carbonation juice 2 obtained in the second carbonation is likewise filtered (Schleicher & Schuell 5893, brown filter, blue ribbon, ash-free, 2 μm). The thin juice is obtained. The color and calcium salt content of the thin juice are determined.

The precipitated calcium carbonate is removed from the clarified raw juice after the first carbonation in the first filtration or after the second carbonation in the second filtration, so that a clarified purified raw juice is obtained. The retentate obtained in the first and second filtrations is collected in a sludge vessel and then pressed to remove water in a lime press.

Results

Figure 3:
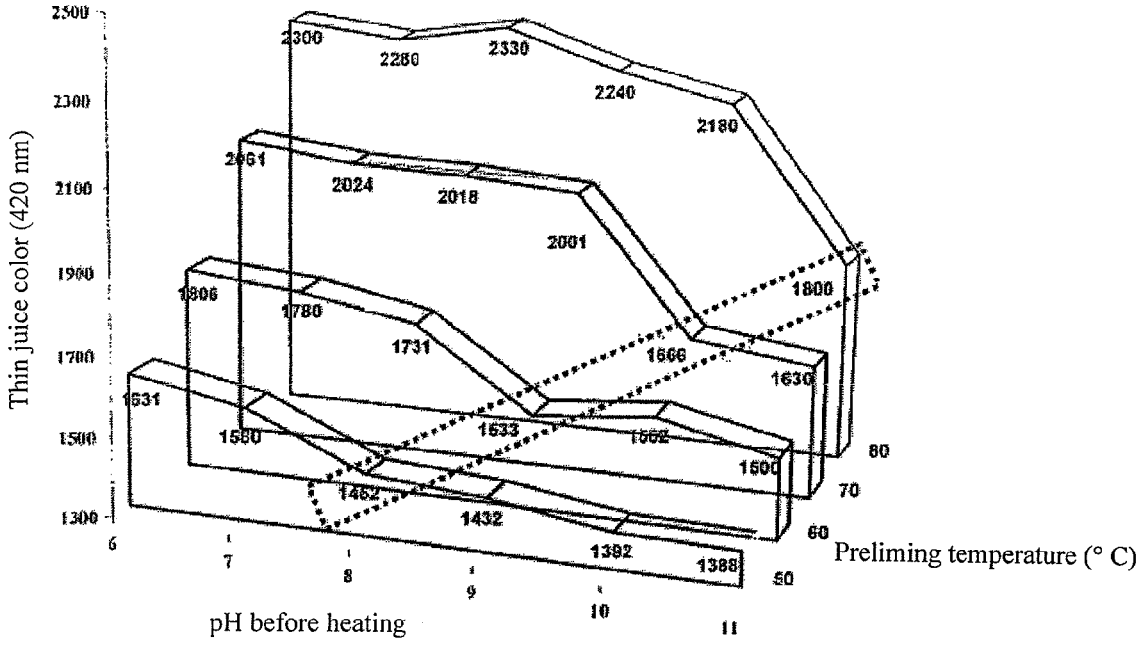
FIG. 3 shows a graphic representation of the dependence of the color of the thin juice on the selected alkalinity in the first (early) raw juice alkalinization in accordance with the invention.
Figure 4:
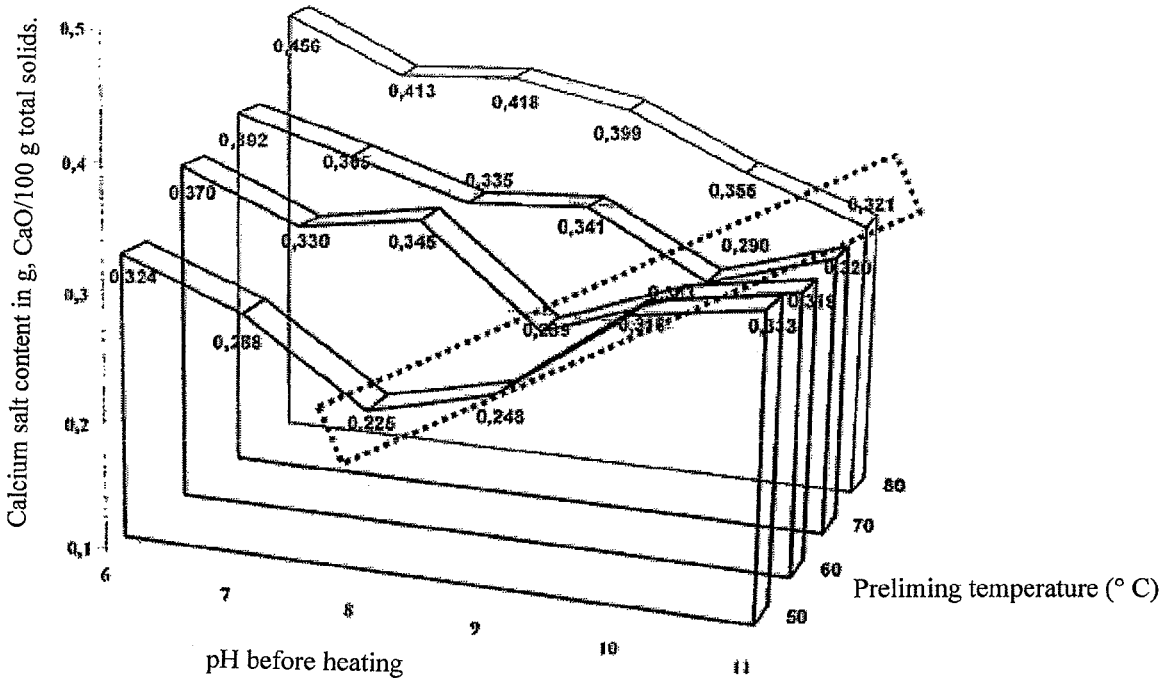
FIG. 4 shows a graphic representation of the dependence of the calcium salt content of the thin juice on the selected alkalinity in the first (early) raw juice alkalinization in accordance with the invention.
Figure 5:
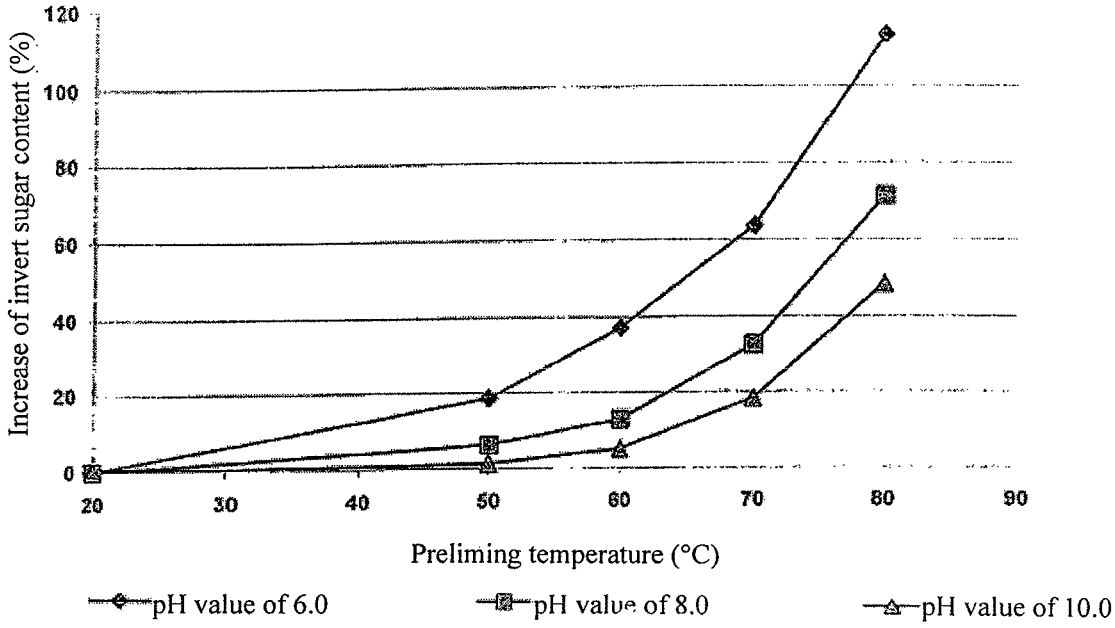
FIG. 5 shows a graphic representation of the dependence of the increase of invert sugars in the raw juice on the preliming temperature and on the selected alkalinity in the first (early) raw juice alkalinization in accordance with the invention.
Figure 6:
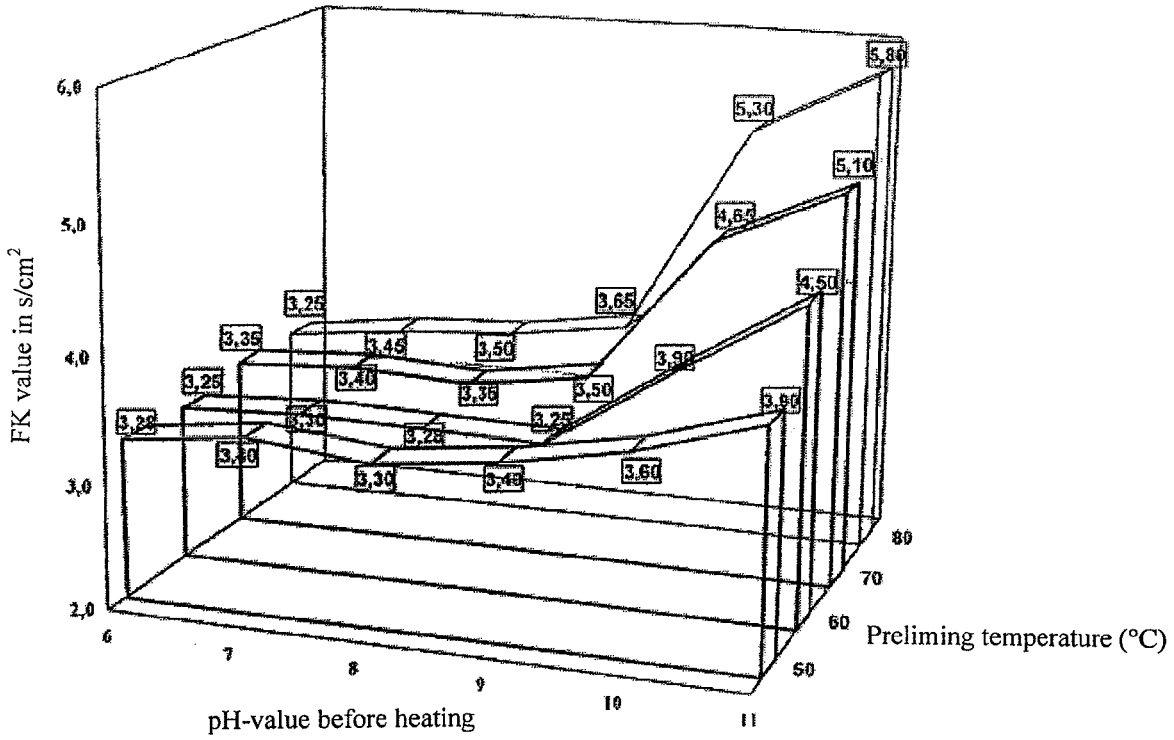
FIG. 6 shows a graphic representation of the dependence of the FK value of the first combination juice on the preliming temperature and on the selected alkalinity in the first (early) raw juice alkalinization in accordance with the invention.

The results of the experiments are shown in FIGS. 3-5. Significant effects of the raw juice alkalinization on the thin juice quality (color and calcium salt content) were established. The thin juice color decreases with increasing preliming temperature. The thin juice color is reduced by alkalinization of the raw juice. The effect of the raw juice alkalinization on the decrease of color of the thin juice is dependent on the preliming temperature: a decrease of the thin juice color of about 200 IU (for a preliming temperature of 50° C.) and a decrease of the thin juice color of about 500 IU (at a preliming temperature of 80° C.).

The calcium salt content of the thin juice decreases with the increase in the prelimed temperature. The calcium salt content of the thin juice decreases with the alkalinization of the raw juice up to an optimum pH value. The required pH value of the raw juice before heating it to achieve the minimum calcium salt content of the thin juice corresponds with the required pH value of the raw juice for the optimum thin juice color.

The optimum raw juice pH that is to be established by the addition of an alkaline agent is dependent on temperature and can be determined by the following empirical equation: c ($H_3O+$) [pH]=a·T[° C.]+b (T=preliming temperature).

The invention claimed is:

1. A method for purification of raw juice obtained in sugar beet extraction, which comprises:

(a) obtaining a raw juice by extraction of sugar beets;

(b) a first alkalinization of the raw juice up to a first alkalinity c which is from pH 7 to pH 11 by the addition of sodium hydroxide or soda or both immediately after the extraction (a), and before introduction to a preliming step;

(c) heating the alkalized raw juice to the preliming temperature T of 75° C. or lower; and (d) preliming the alkalized raw juice at a preliming temperature T of 75° C. by a second alkalinization to a second alkalinity sufficient for flocculation of nonsugar substances;

wherein the second alkalinity has a higher pH than the first.

2. A method as in claim 1, where in step (b) the first alkalinity c is selected dependent on the preliming temperature T.

3. A method as in claim 2, wherein $$c[pH]=a\cdot T[^\circ\,C.]+b$$

where a is from 0.07 to 0.12 and b is from 2 to 4.

4. A method as in claim 3, where a=0.1.

5. A method as in claim 3, where b=3.

6. A method for producing sucrose syrup from sugar beets according to the method of claim 3, further comprising clarifying the alkalinized raw juice, and then obtaining a sucrose syrup from the clarified raw juice.

7. A method as in claim 1, where the first alkalinity in step (b) is always less than the second alkalinity in step (d).

8. A method as in claim 1, where in step (b) the first alkalinity is less than pH 9.

9. A method as in claim 1, where in step (d), the second alkalinization takes place by the addition of milk of lime up to a total concentration of 0.1 to 0.3 g CaO/100 mL.

10. A method as in claim 1, where in step (d), the second alkalinization takes place progressively up to an alkalinity of pH 11 or higher.

11. A method as in claim 1, where in step (d) the second alkalinization takes place progressively up to achievement of the optimum flocculation point.

12. A method as in claim 1 containing the additional step:

(e) main liming of the prelimed raw juice.

13. A method as in claim 12, where in step (b), the main liming comprises:

(e1) a first main liming of the raw juice at a temperature 75° C. or lower, and (e2) a second main liming of the raw juice at a temperature of more than 75° C.

14. A method for producing sucrose syrup from sugar beets according to the method of claim 13, further comprising clarifying the alkalinized raw juice, and then obtaining a sucrose syrup from the clarified raw juice.

15. A method for producing sucrose syrup from sugar beets according to the method of claim 12, further comprising clarifying the alkalinized raw juice, and then obtaining a sucrose syrup from the clarified raw juice.

16. A method for producing sucrose syrup from sugar beets according to the method of claim 1, further comprising clarifying the alkalinized raw juice, and then obtaining a sucrose syrup from the clarified raw juice.

17. A method as in claim 1, wherein the first alkalinization, heating the alkalized raw juice to the preliming temperature T, and preliming the alkalized raw juice are effected without any intermediate removal of solid material.

* * * * *